US005826351A

United States Patent [19]

Tsuji

[11] Patent Number: 5,826,351

[45] Date of Patent: Oct. 27, 1998

[54] SHOE SOLE AND SHOE AND SANDAL INCLUDING THE SOLE

[75] Inventor: Hiroaki Tsuji, Okayama, Japan

[73] Assignee: Keihan Tsusho Co., Ltd., Osaka, Japan

[21] Appl. No.: 872,074

[22] Filed: Jun. 10, 1997

[30] Foreign Application Priority Data

Feb. 25, 1997 [JP] Japan ..... 9-041028

[51] Int. Cl.[6] ..... A43B 13/00; A43B 13/14

[52] U.S. Cl. ..... 36/25 R; 36/31; 36/103; 36/110

[58] Field of Search ..... 36/25 R, 30 R, 36/31, 103, 110, 114

[56] References Cited

U.S. PATENT DOCUMENTS

| | | | |
|---|---|---|---|
| 4,262,433 | 4/1981 | Hagg et al. | 36/25 R |
| 4,348,821 | 9/1982 | Daswick | 36/30 R |
| 4,425,721 | 1/1984 | Spronken | 36/110 |
| 5,339,542 | 8/1994 | Kim . | |
| 5,507,106 | 4/1996 | Fox | 36/103 |
| 5,579,591 | 12/1996 | Kousaka et al. | 36/31 |
| 5,592,757 | 1/1997 | Jackinsky | 36/114 |

FOREIGN PATENT DOCUMENTS

| | | |
|---|---|---|
| 39-4438 | 2/1964 | Japan . |
| 53-46254 | 4/1978 | Japan . |
| 55-131102 | 9/1980 | Japan . |
| 58-87503 | 6/1983 | Japan . |
| 59-8603 | 1/1984 | Japan . |
| 60-170104 | 11/1985 | Japan . |
| 62-74301 | 4/1987 | Japan . |
| 63-10903 | 1/1988 | Japan . |
| 1-155846 | 6/1989 | Japan . |
| 6-261801 | 9/1994 | Japan . |
| 3019544 | 10/1995 | Japan . |

OTHER PUBLICATIONS

"Ashinohanashi", Shiro Kondo, Iwanamishinsho, Iwanami Shoten Publishers, 3rd printing, Sep. 1982.

*Primary Examiner*—M. D. Patterson
*Attorney, Agent, or Firm*—McDermott, Will & Emery

[57] ABSTRACT

A shoe sole which enables the Aori movement of a foot to be readily performed is obtained. According to the invention, the shoe sole is formed of a toe portion 10 and a main portion 20. Toe portion 10 has one upper surface F (first upper surface) and one bottom surface portion (first bottom surface portion). Main portion 20 has one upper plane E (second upper plane), and three bottom surface portions B, C and D (second, third and fourth bottom surface portion). The thickness (t2) of a portion on the lateral side of bottom surface portion C of main portion 20 is formed smaller than the thickness (t1) of a portion on the medial side. Bottom plane C (third bottom surface portion) permits a foot to supinate in a natural manner in dorsiflexial position when the third bottom surface portion touches the plane of walking. By the interaction between such third bottom surface portion and the first, second, and fourth bottom surface portion as described above, during walking, the fourth bottom surface portion first touches the ground, a foot supinates when the third bottom surface portion touches the ground, then the body weight is shifted toward the medial side by the second bottom surface portion, and finally the first bottom surface portion supinates for kicking the ground. In other words the "Aori movement" of the foot is readily performed.

9 Claims, 16 Drawing Sheets

PRONATION OF BACK PART

NORMAL FOOT VIEWED FROM THE BACK

SUPINATION OF BACK PART

SHOE SOLE AND SHOE AND SANDAL INCLUDING THE SOLE

BACKGROUND OF THE INVENTION

1. Field of the Invention

The present invention relates generally to shoe soles, and shoes and sandals including the soles, and more particularly to a shoe sole having a plurality of sole portions, and a shoe and a sandal including such a sole.

2. Description of the Background Art

It is understood that the structure and function of a foot cannot be ignored in the manufacture of a shoe sole. Now, the structure and function of a foot will be described.

As shown in FIG. 19, a foot may be divided into 26 bone portions. Referring to FIG. 19, a foot is anatomically divided into forepart 110, middle part 120 and back part 130 by Chopart's joint 145 and Lisfranc's joint 140. In the connection with shoe soles, however, forepart 110 is preferably divided into a toe portion 113 and a metatarsal bone portion 111 by metatarsophalangeal joint (MP joint) 112. More specifically, in the context of shoe soles, a foot should be considered as consisting of back part 130, middle part 120, the metatarsal bone portion 111 of forepart 110 and the toe portion 113 of forepart 110.

Thus dividing human foot bones into the four parts (111, 113, 120, 130) by the three joints (112, 140, 145) is closely related to four phases in walking on foot (in which the heel touches the ground, the sole touches the ground, the heel is lifted from the ground, and the toes kick the ground). More specifically, back part 130 is related to the phase of heel touching the ground, middle part 120 with the phase of the sole touching the ground, the metatarsal bone portion 111 of forepart 110 with the phase of heel being lifted from the ground, and the toe portion 113 of forepart 110 with the phase of kicking.

Chopart's joint 145 consists of medial talonavicular joint 145*a* and lateral calcaneocuboid joint 145*b*. The foot bones are divided into a medial group 150 and a lateral group 160 by the axes of movement of these two joints.

Medial group 150 consists of a talus 131, a navicular bone 121, three cuneiform bones 123 (123*a*–123*c*), three medial metatarsal bones 111*a*–111*c*, and toe bones 113*a*–113*c* connected to the three metatarsal bones 111*a*–111*c*. Lateral group 160 consists of a heel bone 132, a cuboid bone 122, two lateral metatarsal bones 111*d* and 111*e* and toe bones 113*d* and 113*e* connected to these two metatarsal bones 111*d* and 111*e*. As shown in FIG. 20, at the time of supination, medial group 150 rides on lateral group 160. Medial group 150 and lateral group 160 are related to longitudinal arches which will be described later.

The axes of medial group 150 and lateral group 160 are positioned in parallel to each other as shown in FIGS. 21A and 21B at the time of pronation and make the foot flexible. In supination, as shown in FIGS. 22A and 22B, the axis of medial group 150 crosses the axis of lateral group 160 to firmly lock the foot. Lateral group 160 keeps balance in standing upright, and makes the movement of the foot smooth in walking. Medial group 150 which bears the body weight functions as a spring to kick the ground.

Plantar flexion as shown in FIG. 23C and dorsiflexion as shown in FIG. 23B are known as main movements of a foot. The dorsiflexion has a range of motion up to about 20°, and the plantar flexion has a range of motion up to about 40°. The angle of articulations of a foot in walking changes up to about 10° in dorsiflexion and up to 20° in plantar flexion.

Other than dorsiflexion and plantar flexion, the movement of a foot includes adduction (A) and abduction (B) as shown in FIGS. 24A and 24B, supination (A) and pronation (B) as shown in FIGS. 25A and 25B, inward turning (A) and outward turning (B) as shown in FIGS. 26A and 26B, and the pronation (A) and supination (C) of the back part as shown in FIGS. 27A and 27B.

Two arches may be defined for a foot in each of the longitudinal and transverse direction. More specifically, as shown in FIGS. 28A and 28B, there are a longitudinal arch 171 connecting A and C, a longitudinal arch 172 connecting B and C, a transverse arch 173 connecting A and B, and a transverse arch 174 connecting D and E.

FIG. 29 shows foot bones viewed from the medial side, and medial longitudinal arch 171 is positioned on the medial side. Medial longitudinal arch 171 does not touch the walking plane (ground). The curve of medial longitudinal arch 171 becomes more gentle and its top is slightly lowered by the body weight in a normal state, while the tension of the plantar muscle restricts the medial longitudinal arch 171 from being further lowered.

FIG. 30 shows the foot bones viewed from the lateral side, and lateral longitudinal arch 172 is positioned on the lateral side. When lateral longitudinal arch 172 bears the body weight, the tuberosity 211*e* of the fifth metatarsal bone 111*e* touches the ground and thus the foot attains a stable state.

The two transverse arches intersect second metatarsal bone 111*b*, the longitudinal axis of the foot, and are positioned at the forepart and back part. Fore transverse arch 173 is defined by the heads of five metatarsal bones. Transverse arch 173 becomes shallower when the body weight weighs thereon. Hind transverse arch 174 is a smaller arch defined by three cuneiform bones 123*a*–123*c* and cuboid bone 122. Hind transverse arch 174 does not change by the load of the body weight.

In the supporting structure by lateral longitudinal arch 172 as described above, the heel touches the ground and then the lateral side of the sole touches the ground to absorb the strong impact by touching the ground at the time of walking or jogging. In this case, after the lateral side touches the ground, the entire sole touches the ground, and the foot pronates to somewhat flatten medial longitudinal arch 171. Since the muscle tension is induced to prevent such flattening of medial longitudinal arch 171, medial longitudinal arch 171 functions rather as a spring. If the function of the muscle is weak, medial longitudinal arch 171 is more flattened and can no longer support a necessary part of the body weight, which makes pronation difficult. Therefore, the shoe sole preferably has such a structure that permits natural supination movement while restricting pronation and restricts the flattening of medial longitudinal arch 171.

A so-called "Aori" or flapping is observed in a natural way of walking on bare foot. In such a bare foot walking described in *ASHINOHANASHI*, Shiro Kondo, Iwanamishinsho, 1982, walking by moving a foot from the lateral side to the medial side in a flapping manner reduces energy consumed in the walking, which alleviates walking for a long period of time. More specifically, in the "Aori" walking, the lateral edge of a foot touches the ground, the entire sole touches the ground, the heel is lifted from the ground, the body weight weighs on the toes, and the toes kick the ground. In other wards, the foot performs supination followed by pronation since the heel touches the ground until the entire sole touches the ground, and conversely performs pronation followed by supination since the sole touches the ground until the toes kicks the ground.

The bottom of a conventional general shoe sole is flat and has the same thickness on the medial side and lateral side, the sole of a foot lands on the ground not via its lateral edge during transition from the landing of the heel to the landing of the sole. Therefore, the supination to let the lateral side edge of the foot land on the ground is not permitted. As described above, such a conventional general shoe sole does not permit the supination during transition from the landing of the heel to the landing of the entire sole on the ground, which makes difficult the "Aori movements".

Note that the inventor has proposed several kinds of shoe soles having a plurality of outsole portions in Japanese Utility Model Registration No. 3019544, but the proposed plurality of outsole portions are each equal in thickness between the medial side and lateral side. Therefore, as is the conventional general shoe sole as described above, the entire sole mostly lands not via the lateral edge during transition from the landing of the heel to the landing of the entire sole, and therefore the supination including the landing of the lateral edge is not permitted, which makes difficult the "Aori movement".

Another shoe sole having a plurality of outsole portions is disclosed by Japanese Patent Laying-Open No. 6-261801, but the plurality of outsole portions are each equal in thickness between the medial side and lateral side. Therefore, as is the case with the conventional general shoe sole and the above shoe sole proposed by the inventor, the sole of a foot lands not via the medial edge during transition of the movement from the landing of the heel to the landing of the sole. Therefore, such a supination to let the lateral edge touch the ground is not permitted, which makes difficult the "Aori movement".

A shoe sole which permits standing on toes by removing the heel portion is disclosed by Japanese Utility Model Publication No. 39-4438, Japanese Utility Model Laying-Open No. 53-46254, Japanese Utility Model Laying-Open No. 55-131102, Japanese Utility Model Laying-Open No. 58-87503, Japanese Utility Model Laying-Open No. 59-8603, Japanese Utility Model Laying-Open No. 60-17014, Japanese Patent Laying-Open No. 62-74301, Japanese Utility Model Laying-Open No. 63-10903, or U.S. Pat. No. 5,339,542, but any of the disclosed shoe soles is not directed to such "Aori movement". Therefore in these shoe soles, the medial side of the sole is as thick as the lateral side, which makes difficult the "Aori movement".

Meanwhile, Japanese Patent Laying-Open No. 1-155846 discloses a shoe sole having a lateral side which is easy to wear away formed wider than the medial side which is less easy wear away for the purpose of equalizing the degree of abrasion between the lateral side and medial side of the shoe sole. However, the shoe sole has the same thickness between the medial side and lateral side, and therefore the shoe sole again does not permit the "Aori movement".

As described above, a various kinds of shoe soles have been proposed, any of the shoe soles does not permit supination movement during transition from the landing of the heel to the landing of the sole of a foot, and as a result, the "Aori movement" was not permitted.

SUMMARY OF THE INVENTION

It is an object of the invention to provide a shoe sole which permits the Aori movement of a foot to be readily permitted.

Another object of the invention is to provide a shoe sole including the structure which permits natural supination movement and restricts the flattening of medial side longitudinal arch.

A shoe sole according to one aspect of the invention includes a toe portion and a main portion. The toe portion has a first upper surface mainly supporting the toes of the forepart of a foot, and a first bottom surface portion which touches the plane of walking. The main portion has a second upper surface, and second, third and fourth bottom surface portions. The second upper surface is formed continuously with the toe portion, and mainly supports the metatarsal bones of the forepart of a foot, the middle part and the back part. The second bottom surface portion is connected in a flexible manner to the first bottom surface portion, and inclined at a prescribed angle clockwise to the second upper surface when viewed from the medial side. The third bottom surface portion is provided continuously with the second bottom surface portion and virtually in parallel with the second upper surface. The third bottom surface portion is thinner on the lateral side of a foot smaller than the thickness of the medial side. The fourth bottom surface portion which is formed virtually flat and continuously with the third bottom surface portion is inclined at a prescribed angle anticlockwise to the second upper surface when viewed from the medial side of the shoe.

The shoe sole according to this aspect, the third bottom surface portion is thinner on the lateral side of a foot than the thickness of the medial side, and therefore the foot can naturally perform supination in dorsiflexion, thus restricting the flattening of medial longitudinal arch. By the interaction between the third bottom surface portion and the first, second and fourth bottom surface portions, the fourth bottom surface portion touches the ground first, and then the foot spinates when the third bottom surface portion touches the ground, the body weight shifts to the medial side at the second bottom surface portion, and finally the foot kicks the ground by the first bottom surface portion while supination, in other words the "Aori movement" of the foot may be easily permitted. Such "Aori movement" of a foot reduces energy consumed in walking, thus alleviating walking for a longer period of time. Since the "Aori movement" of the foot is permitted, the natural movement of the foot is not restricted as opposed to the conventional shoe soles, which advantageously provides more comfortable walking than the conventional shoe soles does. Since the forth bottom surface portion of the main portion is inclined at a prescribed angle anticlockwise to the second upper surface, when the fourth bottom surface portion touches the plane of walking, the toe portion is lifted. Thus downward rotation function effected on the foot may be alleviated. As a result, the plantar flexion moment of the foot joints when the heel touches the ground is reduced and, therefore the user may easily walk with his knees in an extended position.

In the shoe sole according to the aspect, the main portion may be formed of a material having hardness enough to support the body weight, and the toe portion may be formed of a material less hard than the main portion. Thus, the moving ability of the main portion relative to the toe portion may be improved. The third bottom surface portion may be wider at the medial side portion of a foot than the lateral side portion. Furthermore, the third bottom surface portion may be formed in a grooved manner with respect to the second and fourth bottom surface portions. The main portion including the third bottom surface portion is usually formed of a material having a certain degree of resilience, and in the third bottom surface portion thus formed in a grooved manner, the side end face portion on the side of groove in the third bottom surface portion positioned at the boundary with the second and fourth bottom surface portion becomes easy to bend. When a portion corresponding to the third bottom surface portion touches the ground after the landing of the fourth bottom surface portion, the side end face portion on the side of groove in the third bottom surface portion bends, as a result, the impact may be absorbed and the foot can advantageously easily supinate. Furthermore, in the shoe sole according to the aspect, the fourth bottom surface portion may have a recess on both side end portions of the medial and lateral sides. In such a structure, the weight imposed on the fourth bottom surface portion may be reduced, and the center of gravity of the shoe sole may be readily positioned at the second bottom surface portion.

In a shoe including the shoe sole according to the aspect, the vertical line from the center of gravity of the shoe may passes through the second bottom surface portion, and the vertical line from the center of the gravity of the user of the shoe may pass through the second bottom surface portion. Thus positioning the center of gravity on the second bottom surface portion, the sural muscle is not much used when standing on the second bottom surface portion.

A sandal including the shoe sole according to the aspect may be formed. The use of the shoe sole as described above also permits natural supination movement of a foot in dorsiflexion when the third bottom surface touches the plane of walking, and therefore the flattening of medial longitudinal arch may be restricted. By the intersection between the third bottom surface portion and the first, second and fourth bottom surface portion, the foot supinates and then pronates since the heel touches the ground until the sole lands on the ground, and conversely pronates and then supinates since the sole lands on the ground until the foot kicks the ground, and as a result, the so-called "Aori movement" can be naturally performed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Now, an embodiment of the invention will be described in conjunction with the accompanying drawings.

Figure 1:
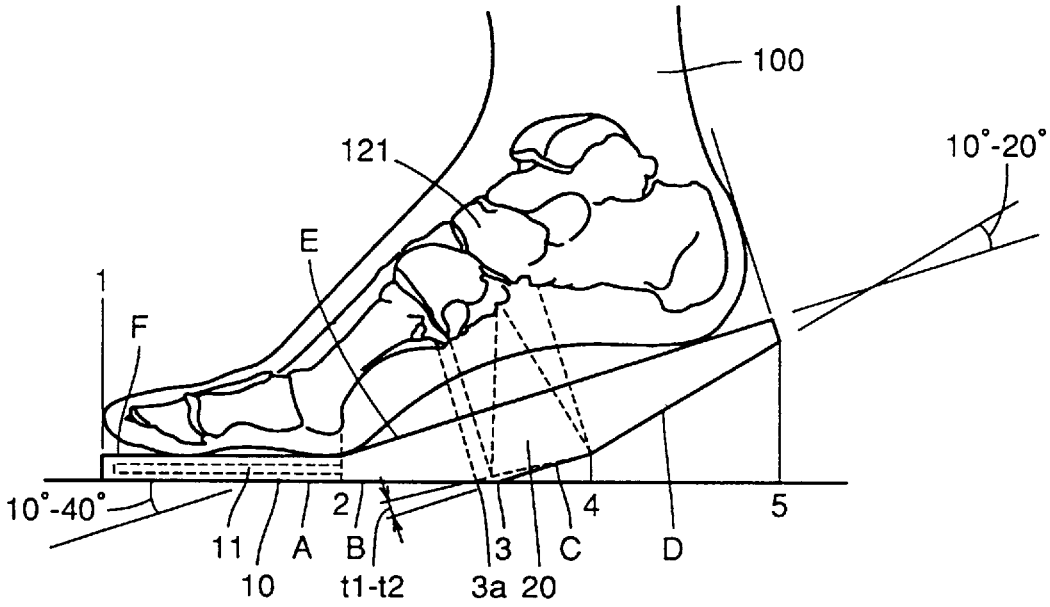
FIG. 1 is a front view showing a shoe sole according to a first embodiment of the invention.
Figure 19:
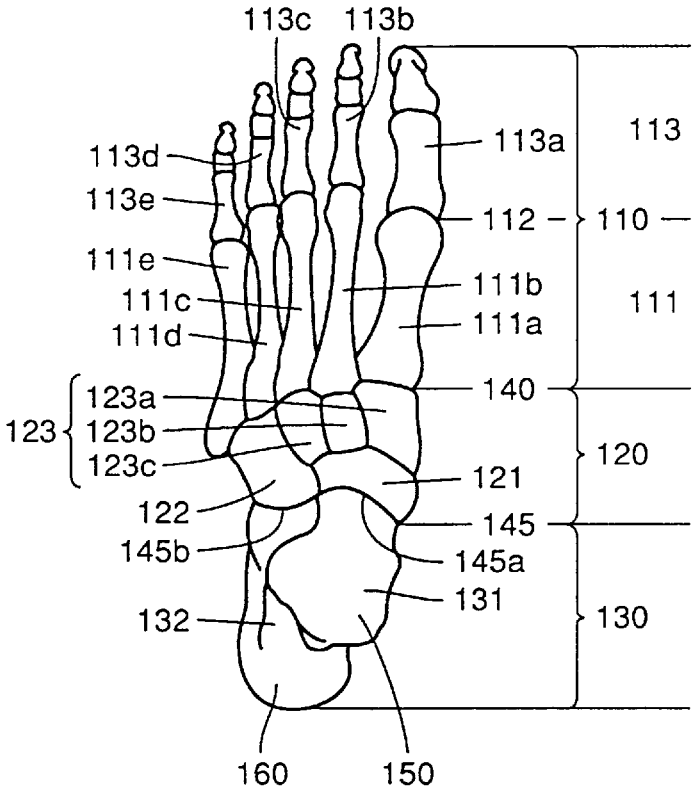
FIG. 19 PRIOR ART
FIG. 19 is a view schematically showing the skeleton of a foot.
Figure 20:
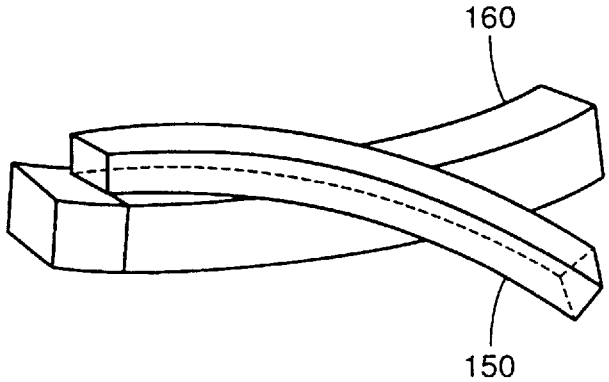
FIG. 20 PRIOR ART
FIG. 20 is a perspective view for use in illustration of the relation between the medial group and lateral group of a foot.
Figure 21A:
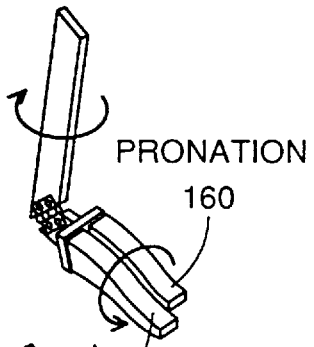
FIG. 21A PRIOR ART
FIGS. 21A and 21B are views for use in illustration of the relation between the medial group and lateral group in the pronation of a foot.
Figure 21B:
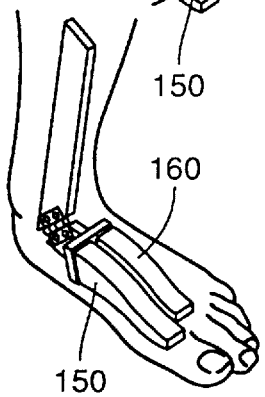
FIG. 21B PRIOR ART
Figure 22A:
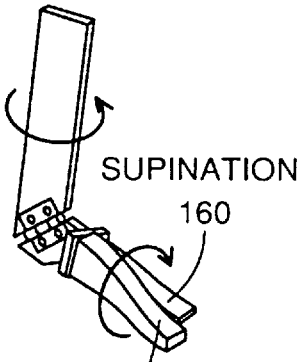
FIG. 22A PRIOR ART
FIGS. 22A and 22B are views for use in illustration of the relation between the medial group and lateral group in the supination of a foot.
Figure 22B:
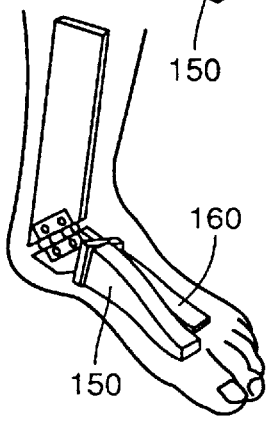
FIG. 22B PRIOR ART
Figure 23A:
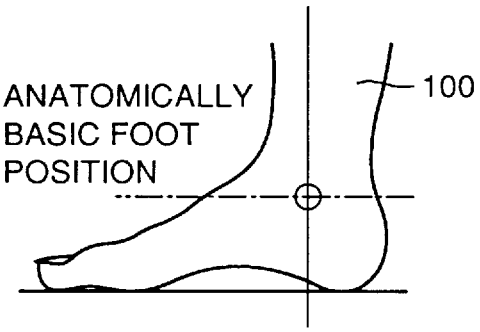
FIG. 23A PRIOR ART
FIGS. 23A, 23B and 23C are views for use in illustration of the dorsiflexion and plantar flexion of a foot.
Figure 23B:
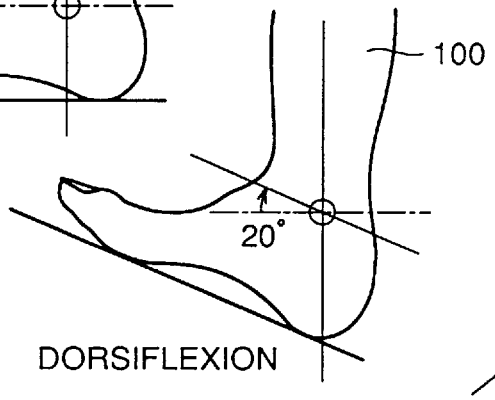
FIG. 23B PRIOR ART
Figure 23C:
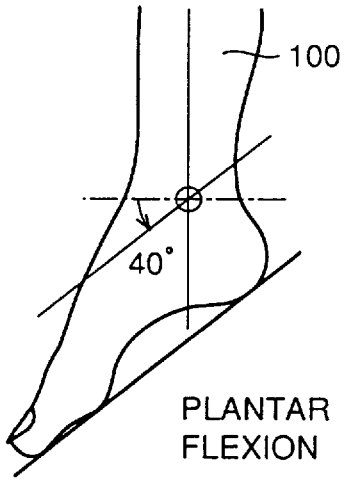
FIG. 23C PRIOR ART
Figure 24A:
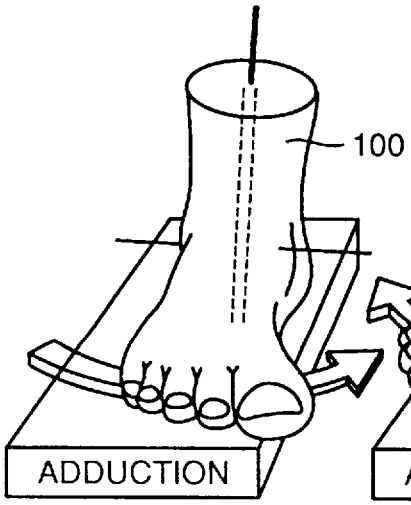
FIG. 24A PRIOR ART
FIGS. 24A and 24B are views for use in illustration of the adduction and abduction of a foot.
Figure 24B:
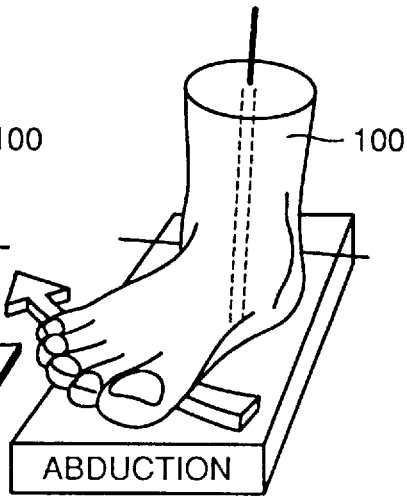
FIG. 24B PRIOR ART

Referring to FIG. 1, a shoe sole according to this embodiment includes a toe portion 10 formed from a relatively soft material and a main portion 20 having sufficient hardness for supporting the body weight of a person. Toe portion 10 and main portion 20 are joined flexibly to each other at a ball joint portion of the shoe that corresponds to the position of the metatarsophalangeal joint 112 (which functions as a support point for flexion when standing on toe, see FIG. 19).

Toe portion 10 has an upper plane F (first upper plane) a toe portion of a foot sole is in contact with, and bottom surface portion A (first bottom surface portion) in contact with the plane of walking on ground. Toe portion 10 is filled inside with a flexible member 11 constructed of cork, sponge or the like. Main portion 20 includes one upper plane E (second upper plane) with which the foot sole is in contact with, three bottom surface portions B (second bottom surface portion) in contact with the plane of walking, a bottom surface portion C (third bottom surface portion) and a bottom surface portion D (fourth bottom surface portion).

The bottom surface portions B, C and D of main portion 20 each have an area effective as a surface supporting the body weight. The upper plane E of main portion 20 is inclined upwardly from the upper plane F of toe portion 10 at an angle ranging from 10° to 40°. Therefore, the toes are always in a slight dorsiflexion position relative to the sole.

The vertical line which includes the center of gravity of the shoe sole is positioned in the bottom surface portion B of main portion 20. Therefore, when the shoe sole is placed on a flat surface, the bottom surface portion A of toe portion 10 and the bottom surface portion B of main portion 20 are in contact with the flat surface, and the bottom surface portion C and D of main portion 20 are not in contact with the flat surface. Thus, a user of shoes including the shoe soles according to the invention may stand in a natural and stable manner on bottom surface portion B virtually without using his/her sural muscles.

As shown in FIG. 1, if the bottom surface portion B of main portion 20 is in contact with the plane of walking, the portion of the foot sole in contact with the upper plane E of main portion 20 is inclined upwardly toward the heel at an angle about in the range from 10° to 40° to the plane of walking. The boundary 3-3*a* between bottom surface portion B and bottom surface portion C is positioned under navicular bone 121, and surface portion B supports middle part 120 and the metatarsal bones 111 of forepart 110.

Figure 5:
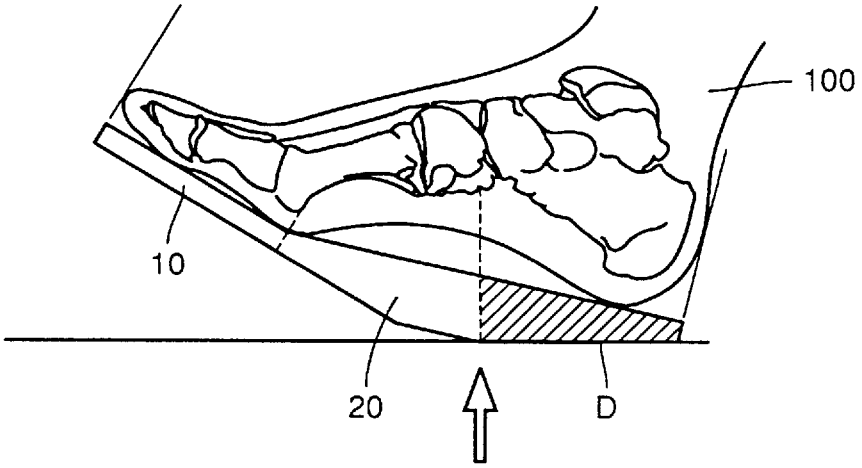
FIG. 5 is a view for use in illustration of the movement of the shoe sole when the heel portion touches the ground according to the first embodiment of the invention shown in FIG. 1.

As shown in FIG. 5, when the third bottom surface portion D of main portion 20 is in contact with the plane of walking, the foot sole in contact with upper plane E of main portion is inclined at an angle about in the range from 10° to 20° to the plane of walking such that the toe portion is raised. The boundary between bottom surface portion D and bottom surface portion C is positioned under the joint of navicular bone 121 and cuneiform bone 123, and completely supports the navicular bone 121 of middle part 120.

Figure 4:
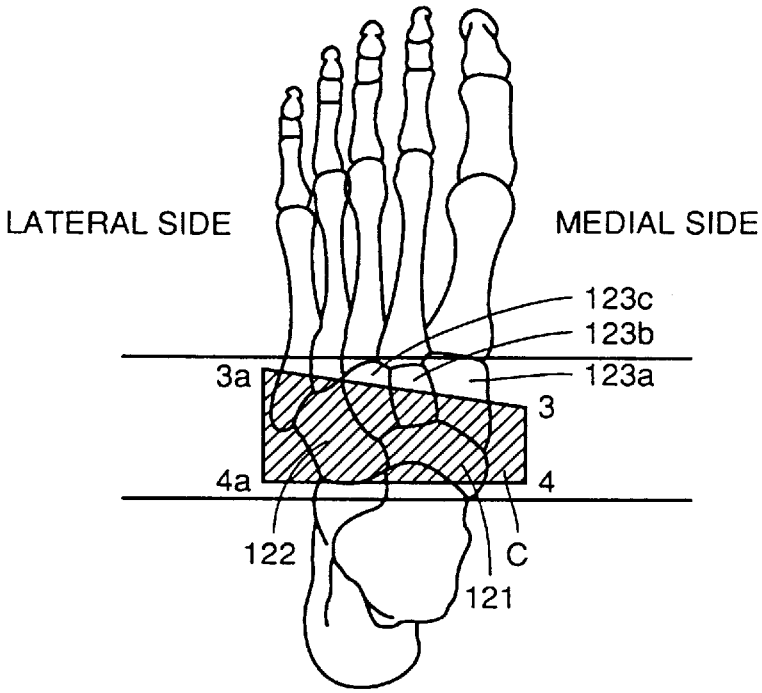
FIG. 4 is a top view showing bottom portion C shown in FIG. 3.

As shown in FIG. 1, the bottom surface portion C of main portion 20 is formed virtually in parallel with the foot sole (upper plane E). Therefore, if bottom surface portion C is in contact with the plane of walking, a portion of the foot sole in contact with upper plane E is in parallel with the plane of walking. The other bottom surface portions A, B and D are separated from the plane of walking. Also in this case, as shown in FIG. 4, the boundary 3-3*a* between bottom surface portion C and bottom surface portion B is positioned virtually under medial cuneiform bone 123*a*, while the boundary 4-4*a* between bottom surface portion C and bottom surface portion D is positioned virtually under Chopart's joint 145. Therefore, when bottom surface portion C is in contact with the plane of walking, the middle part 120 of the foot is supported on bottom surface portion C.

Figure 3:
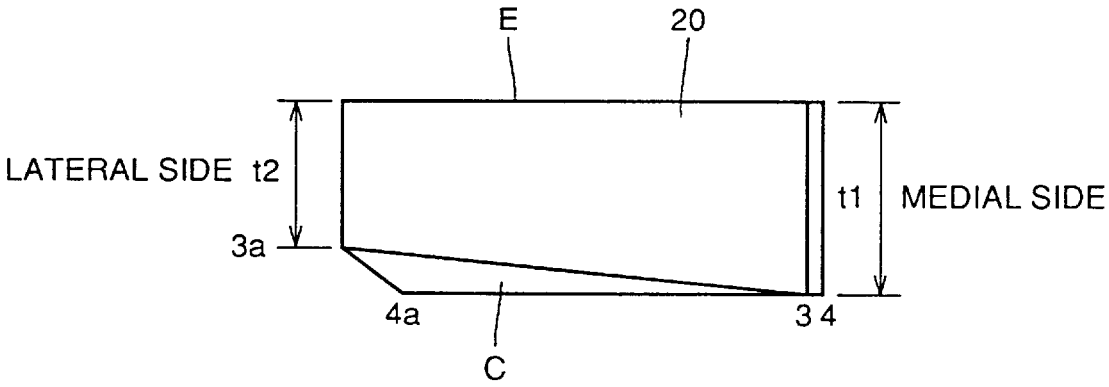
FIG. 3 is a side cross sectional view showing bottom portion C shown in FIGS. 1 and 2.
Figure 6:
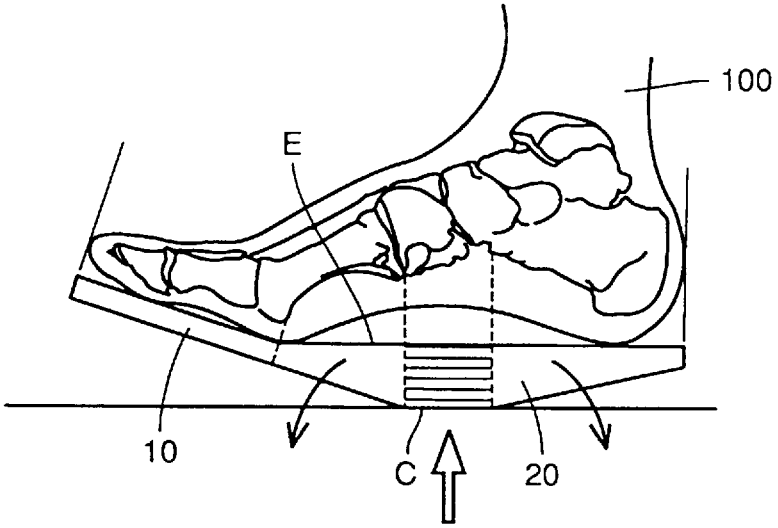
FIG. 6 is a view schematically showing the movement of the shoe sole when the entire sole touches the ground according to the first embodiment shown in FIG. 1.
Figure 7:
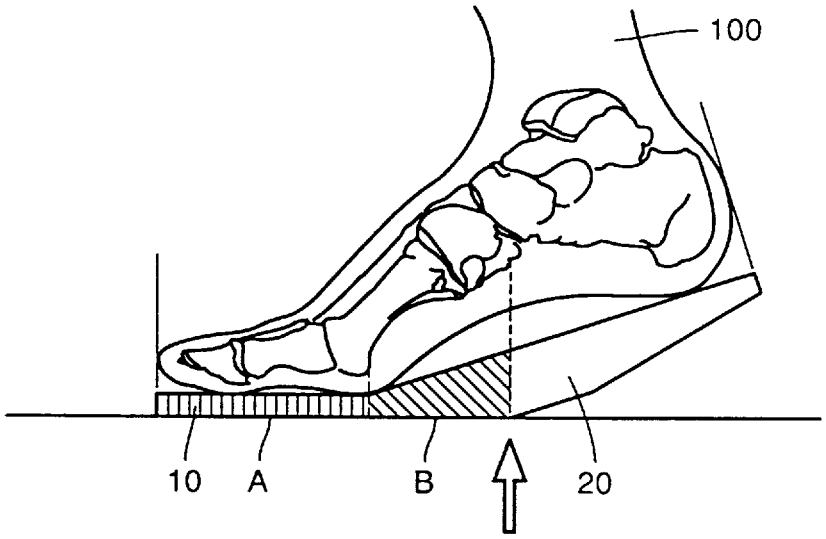
FIG. 7 is a view for use in illustration of the movement of the shoe sole when the heel portion is lifted from the ground according to the first embodiment shown in FIG. 1.
Figure 8:
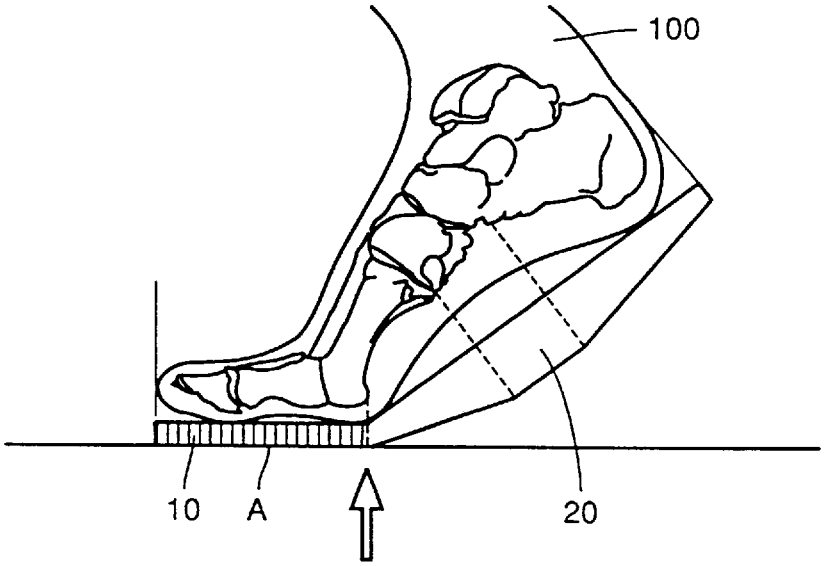
FIG. 8 is a view showing the movement of the shoe sole when the foot kicks the ground according to the first embodiment shown in FIG. 1.
Figure 25A:
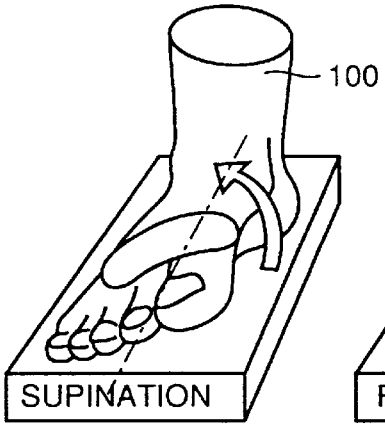
FIG. 25A PRIOR ART
FIGS. 25A and 25B are views for use in illustration of the pronation and supination of a foot.
Figure 25B:
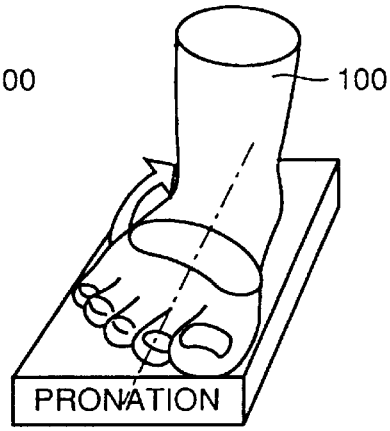
FIG. 25B PRIOR ART
Figure 26A:
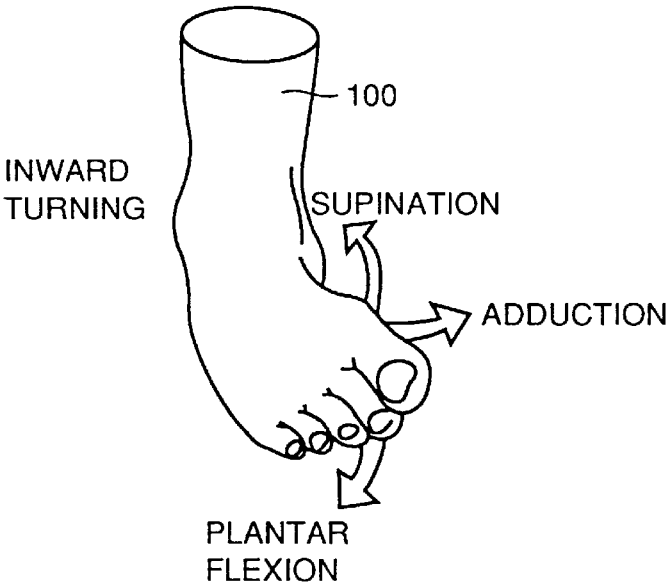
FIG. 26A PRIOR ART
FIGS. 26A and 26B are views for use in illustration of the inward turning and outward turning of a foot.
Figure 26B:
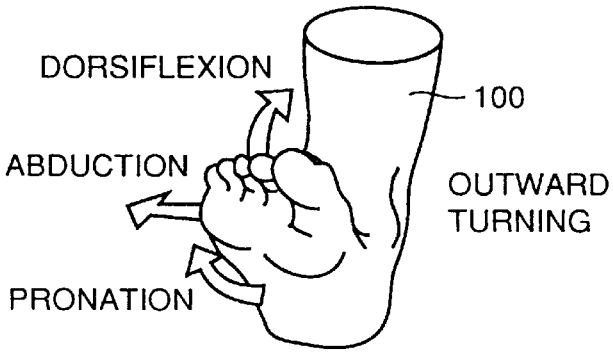
FIG. 26B PRIOR ART

According to this embodiment, as shown in FIG. 3, bottom surface portion C has a smaller thickness (t2) on the lateral side (3*a*) of a foot than the thickness (t1) on the medial side (3) of the foot. Thus, the foot is slightly in a supinated position when bottom surface portion C is in contact with the plane of walking (see FIG. 25). As a result, during walking, as shown in FIG. 5, bottom surface portion D lands on the ground, then the foot supinates at the time of the landing of bottom surface portion C as shown in FIG. 6, and then the body weight shifts toward the medial side by bottom surface portion B as shown in FIG. 7, followed by kicking while supinating on bottom surface portion A as shown in FIG. 8. Accordingly the so-called "Aori movement" can be readily performed. The "Aori movement" of the foot reduces energy consumed in walking, which alleviates walking for a longer period of time. Since the "Aori movement" of the foot is enabled, the natural movement of the foot is not restricted as opposed to the conventional shoe soles, which provides more comfortable walking than those conventional shoe soles.

By making the thickness (t2) of the lateral side of bottom surface portion C of main portion 20 smaller than the thickness (t1) on the medial side, standing on the lateral side in dorsiflexion may be alleviated by restricting the pronation during transition from the landing of the heel to the landing of bottom surface portion C, which improves stability in walking as well as prevents the lowering of the medial side longitudinal arch. As a result, the lowering of the medial longitudinal arch which makes it difficult to support a necessary part of body weight is prevented, thus preventing difficulty in pronation.

Figure 2:
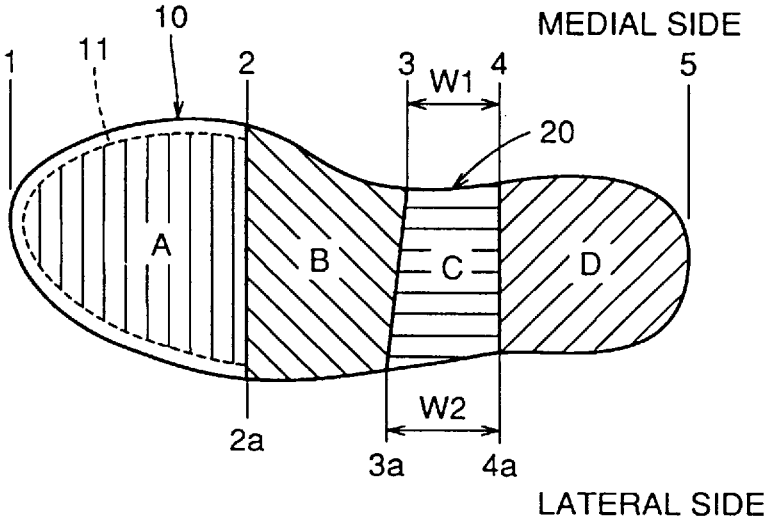
FIG. 2 is a bottom view showing the shoe sole shown in FIG. 1.

Note that thickness (t2) on the lateral side of bottom surface portion C is preferably smaller than the thickness (t1) on the medial side by about 1–10 mm. If the thickness of portions of bottom surface portion C of main portion 20 is thus adjusted, the width (w1) of the medial side of bottom surface portion C is smaller than the width (w2) of the lateral side based on the manner in which bottom surface portion C, B and D are connected as shown in FIG. 2. In this case, bottom surface portions A, B and D are formed equal in thickness on the medial and lateral sides.

As shown in FIG. 7, since the bottom surface portion B of main portion 20 supports all the metatarsal bones 111 of the forepart 110 of the foot, the stress imposed on the heads of metatarsal bones may be alleviated, and the boundary with the bottom surface portion A of toe portion 10 may be more movable. As a result, the propelling force of the foot may be prevented from being reduced.

As shown in FIG. 5, when the bottom surface portion D of main portion 20 is in contact with the plane of walking, the foot sole is inclined with respect to the plane of walking with the toe portion being raised, it is easy to keep the dorsiflexion position of the foot joints at the landing of the heel. Therefore, the heel may entirely land on the ground in a stable manner. Since the sole is inclined upwardly with the toe portion being raised by bottom surface portion D, the downward rotating effect upon the foot may be reduced. Thus, the plantar flexion moment of the foot joints at the landing of the heel may be reduced, and therefore the impact in walking may be reduced. Note that the plantar flexion moment of the foot joints is the sum of moment by the effect of the body weight supported on the landing point of the heel and moment by the effect of the weight of the foot supported on the center of the foot joints.

In this embodiment, since the plantar flexion moment may be reduced as described above, one can walk while keeping the knees in an extended position. If the extended position of the knees can be maintained, the force of muscles necessary for supporting the body weight may be smaller for a foot in a more straight state. Therefore, energy necessary for walking may be reduced.

Also in this embodiment, one can stand or walk on the toes using bottom surface portion plane A as shown in FIG. 8. The plantar muscles of the foot joints around the tricepses (sura) of the legs may be trained by walking or standing on the toes. As shown in FIG. 5, one can stand or walk on the heels of the foot using bottom surface portion D. The standing or walking on the heels trains the dorsal muscles of ankle joints such as the anterior tibial muscles on the front side of the lower legs.

Figure 9:
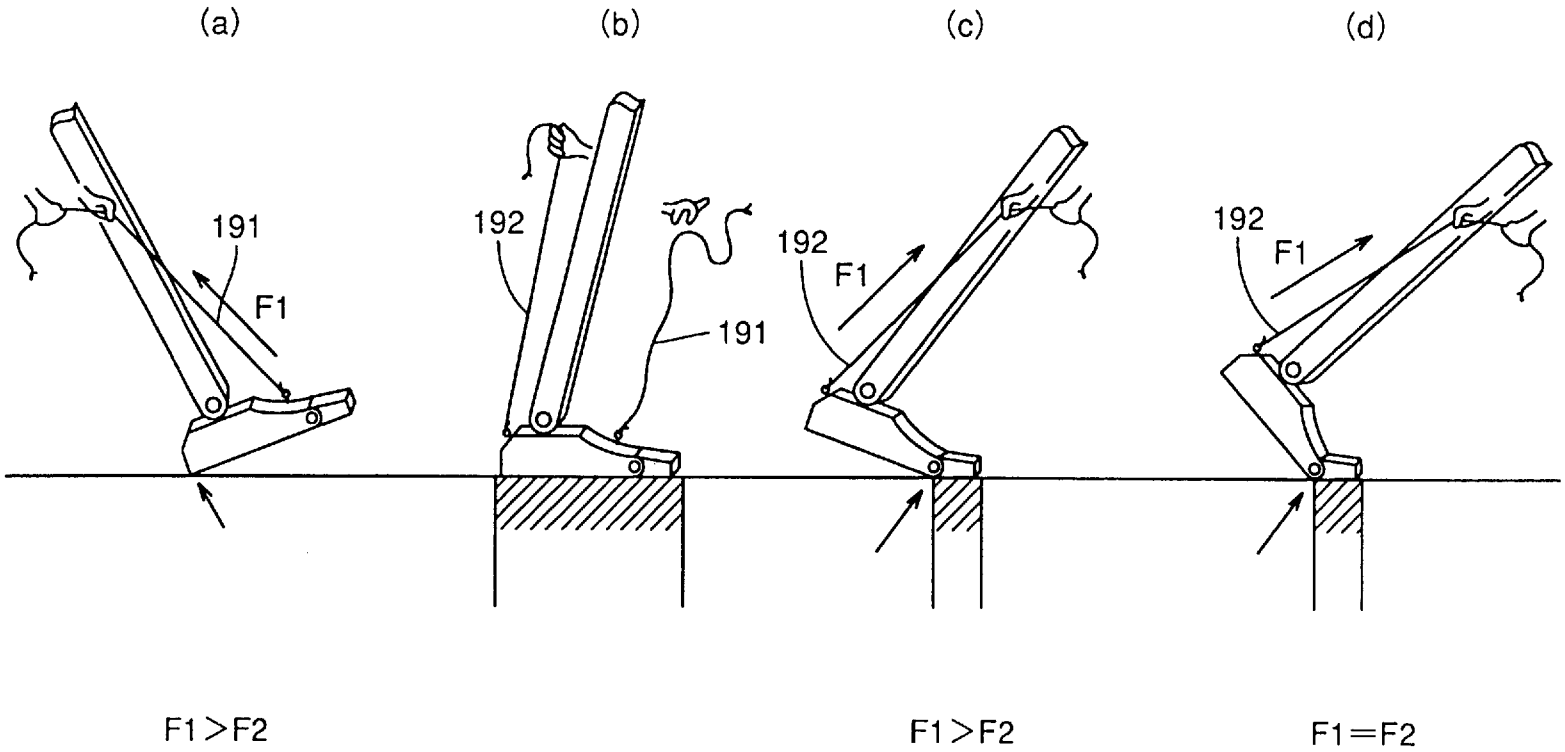
FIG. 9 is a view for use in illustration of the movement of dorsiflexor muscles and plantar flexor muscles in an upright phase in walking using a general shoe.
Figure 10:
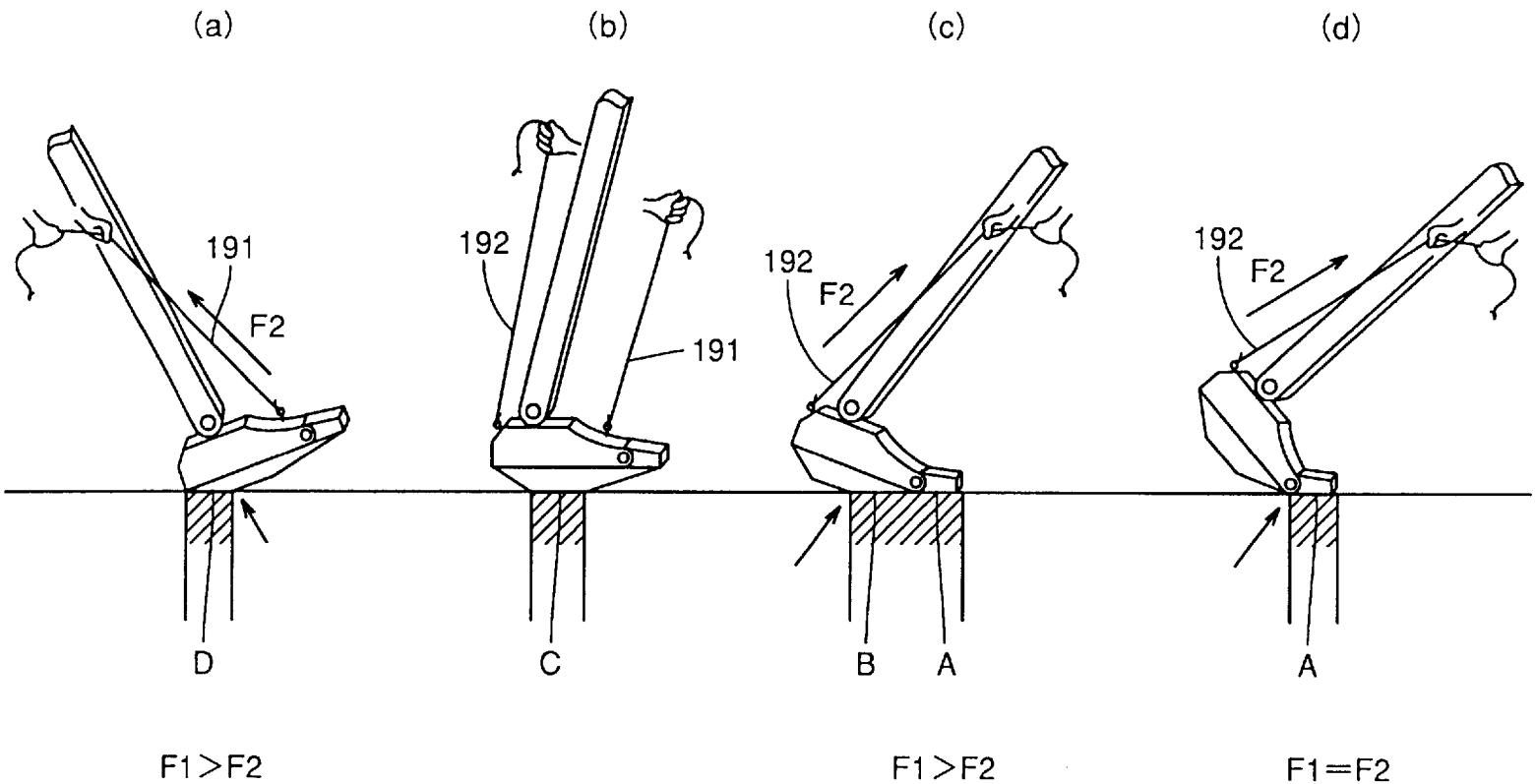
FIG. 10 is a view for use in illustration of the functions of dorsiflexor muscles and plantar flexor muscles in an upright phase in walking using a shoe sole according to the first embodiment shown in FIG. 1.

FIGS. 9 and 10 show how the dorsiflexor muscle and plantar flexor muscle of a leg act against each other in the standing phase in walking. FIG. 9 relates to a general shoe sole, and FIG. 10 relates to the shoe sole according to the first embodiment. Referring to FIGS. 9 and 10, the standing phase in walking may be divided into four phases, the landing of the heel (a), the landing of the sole (b), the lifting of the heel (c) and kicking the ground (d).

In the landing of the heel (a) in FIG. 9, a group of dorsiflexor muscles 191 including the anterior tibial muscles on the front side of a leg works hard to reduce the plantar flexional moment of the ankle joint. In the phase of the landing of the sole (b) in FIG. 9, a large supporting area is stably secured, a group of plantar flexor muscles 192 including the triceps muscle of the calf stands by for the next phase of the lifting of the heel (c), and therefore dorsiflexor muscle group 191 does not work. In the phase of the lifting of the heel (c) in FIG. 9, plantar muscle group 192 actively works to lift the heel, and at the same time to keep the stability of the toes for moving the other foot forward. In the phase of kicking the ground (d) in FIG. 9, the heel of the foot stepped forward has already touched the ground, while planter muscle group 192 actively works to quickly shift the body weight to the foot thus stepped forward.

Meanwhile, in the phase of the landing of the heel (a) of the shoe sole according to this embodiment in FIG. 10, the bottom surface portion D of main portion 20 secures a larger area in contact with the ground as compared to (a) in FIG. 9, the plantar flexional moment is smaller as well, and dorsiflexor muscle group 191 works less hard. Therefore, force F2 effected upon dorsiflexor muscle group 191 in (a) in FIG. 10 is smaller than force Fl effected upon dorsiflexor muscle group 191 in (a) in FIG. 9. Then, in phase the landing of the sole in (b) in FIG. 10, the contact area formed by bottom surface portion C of main portion 20 is smaller than that in (b) in FIG. 9. Therefore, dorsiflexor muscle group 191 and plantar flexor muscle group 192 stand by to be able to start working at any moment, in order to keep the stability in the forward and backward directions until the body weight is completely shifted forward on the foot. Then, in the phase of the lifting of the heel in (c) in FIG. 10, a large area in contact is stably secured by bottom surface portions A and B. Therefore, the other foot may be easily moved forward. Force F2 effected upon plantar flexor muscle group 192 in the phase of the lifting of the heel in (c) in FIG. 10 is smaller than force Fl effected upon plantar flexor muscle group 192 in the phase of the lifting of the heel in (c) in FIG. 9.

Finally in the phase of the kicking the ground in (d) in FIG. 10, under the same condition as the phase of the kicking the ground in (d) in FIG. 9, the body weight is more smoothly shifted by the bottom surface portions, D, C and B, so that the propelling force is stored, the working of plantar flexor muscle group 192 is alleviated as compared to (d) in FIG. 9.

Thus, using the shoe sole according to the embodiment shown in FIG. 10, the force effected upon dorsiflexor muscle group 191 and plantar muscle flexor group 192 in the phases of the landing of the heel and the lifting of the heel may be particularly reduced than the conventional examples. Therefore, sports-associated-disabilities of legs may be prevented.

Figure 11:
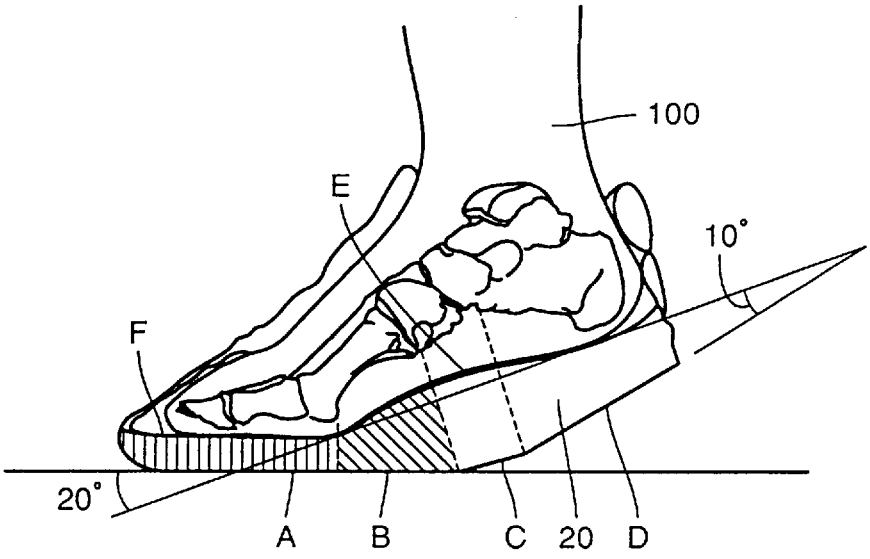
FIG. 11 is a view schematically showing an example of one of a pair of sports shoes using the shoe sole according to the first embodiment.
Figure 12:
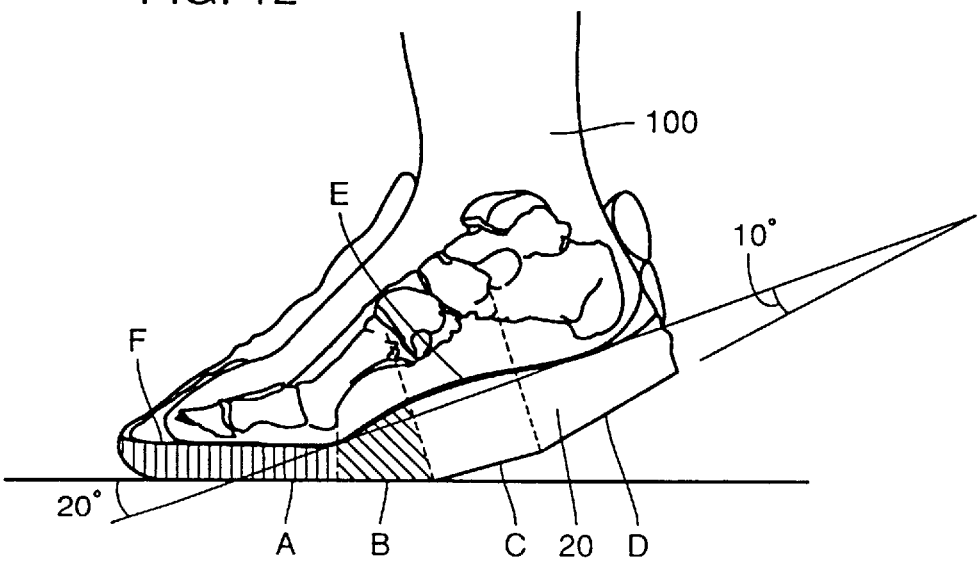
FIG. 12 is a view schematically showing another example of one of a pair of sports shoes using the shoe sole according to the first embodiment of the invention.

FIGS. 11 and 12 show applications of the shoe sole according to the first embodiment shown in FIG. 1 to sports shoes. FIG. 11 is one of a pair of sports shoes for walking or jogging, while FIG. 12 is one of a pair of sports shoes for tennis. The sports shoe shown in FIG. 11 and the sports shoe shown in FIG. 12 are different in that the width of the bottom surface portion C of main portion 20 in the sports shoe for tennis is larger than that of the sports shoe for walking or jogging. Playing tennis involves much movements in the transverse direction, and the lateral side of bottom surface portion C is often used to restrict such a movement in the transverse direction. The width of bottom surface portion C is large enough to readily restrict such movement in the transverse direction in the sports shoe for tennis as shown in FIG. 12.

Figure 13:
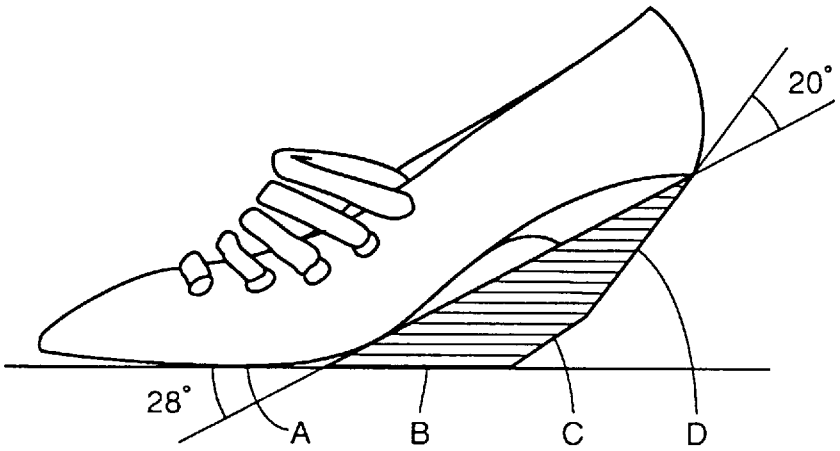
FIG. 13 is a view schematically showing an example of one of a pair of high heeled shoes using the shoe sole according to first embodiment of the invention.
Figure 14:
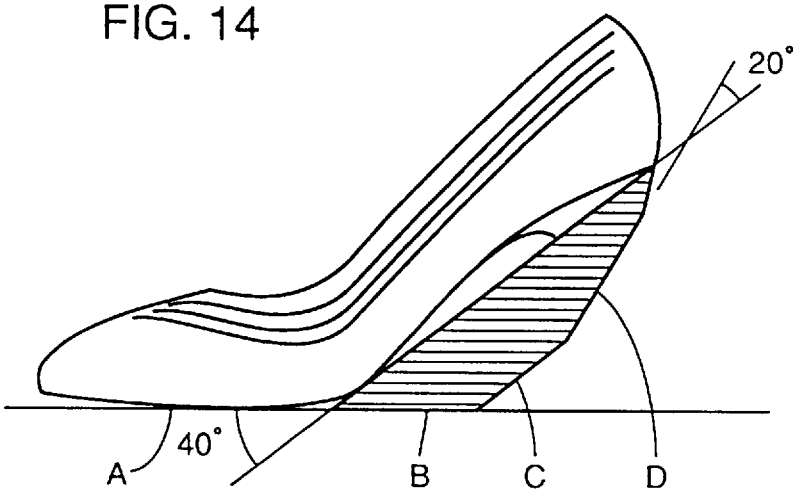
FIG. 14 is a view schematically showing another example of one of a pair of high heeled shoes using the shoe sole according to the first embodiment of the invention.

FIGS. 13 and 14 show applications of the shoe sole according to the first embodiment shown in FIG. 1 to high heeled shoes. As bottom surface portions A and B are in contact with the plane of walking, the sole of a high heeled shoe in FIG. 13 is inclined at an angle of 28°, while the angle of the sole is 40° in a high heeled shoe shown in FIG. 14. The angle of bottom surface portion D relative to the foot sole of the high heel shown in FIG. 13 and the angle of bottom surface portion D relative to the foot sole of the high heeled shoe in FIG. 14 are both 20°.

Figure 15:
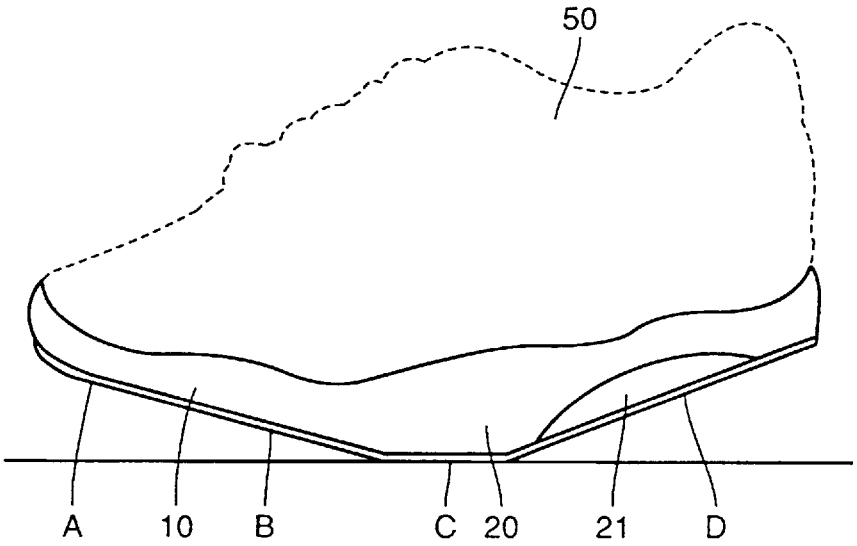
FIG. 15 is a view showing an example of a shoe to which the shoe sole according to the invention is applied.
Figure 16:
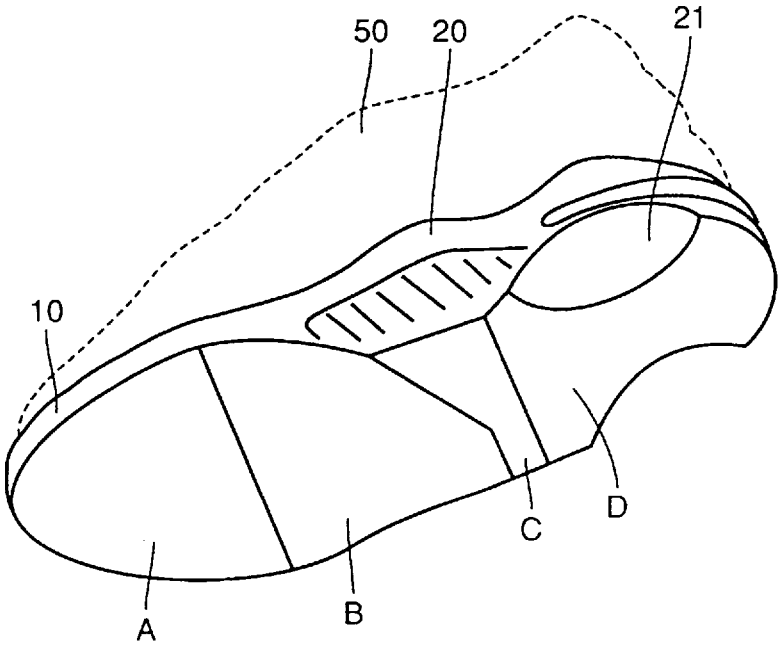
FIG. 16 is a perspective view for use in illustration of the bottom of the shoe shown in FIG. 15.
Figure 17:
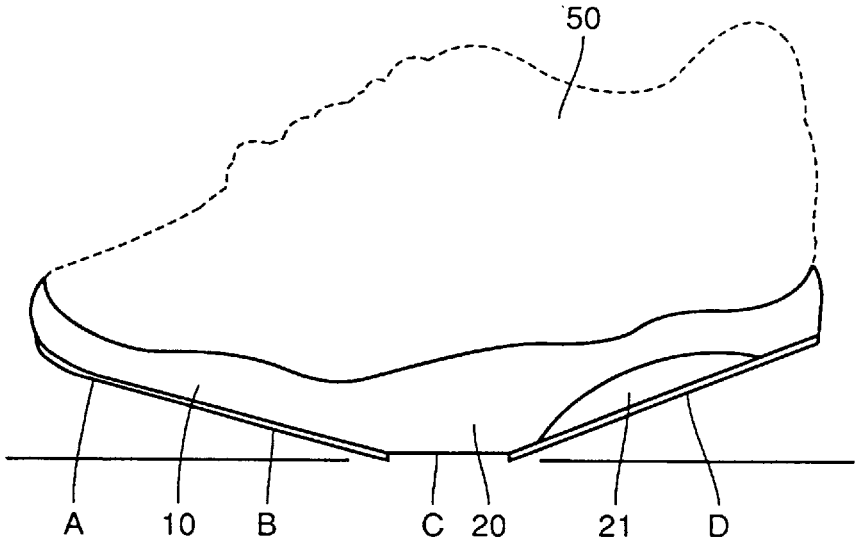
FIG. 17 is a view schematically showing another example of a shoe to which the shoe sole according to the invention is applied.
Figure 18:
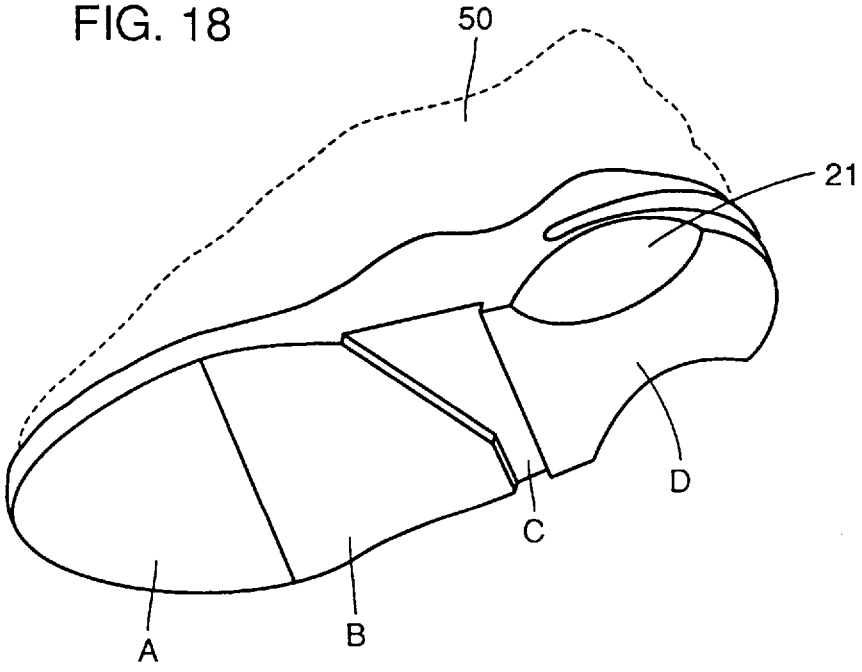
FIG. 18 is a perspective view for use in illustration of the bottom of the shoe shown in FIG. 17.

FIG. 15 is a view schematically showing an example of a shoe to which the shoe sole according to the invention is applied, and FIG. 16 is a perspective view showing the bottom surface portion of the shoe shown in FIG. 15. FIG. 17 is a view schematically showing another example of a shoe to which the shoe sole according to the invention is applied, and FIG. 18 is a perspective view showing the bottom surface of the shoe shown in FIG. 17. Also in these examples in FIGS. 15 to 18, in the bottom surface portion C of main portion 20, the thickness on the lateral side of a foot is formed smaller than the thickness on the medial side. Thus, the foot may take a slightly supinated position when bottom surface portion C is in contact with the plane of walking. As a result, during walking, as shown in FIGS. 5 to 8, bottom surface portion D first touches the ground, then the foot supinates during the landing of bottom surface portion C, the weight is shifted to the medial side on bottom surface portion B, followed by the kicking the ground by bottom surface portion A while pronation, in other words the so-called "Aori movement" of the foot may be easily performed. Thus, energy consumed in walking may be reduced, which alleviates walking for a longer period of time.

In addition, since the thickness (t2) on the lateral side of bottom surface portion C of main portion 20 is formed smaller than the thickness (t1) on the medial side, one can easily stand on foot on the lateral side in a dorsiflexional position while restricting pronation during transition from the landing of the heel to the landing of the bottom surface portion C, which improves stability during walking as well as preventing the lowering of the medial side longitudinal arch. In other words, the lowering of medial longitudinal arch which makes it difficult to support a necessary amount of the body weight can be effectively prevented.

In a shoe 50 in FIGS. 15 and 16, the boundary between bottom surface portion C and bottom surface portion B or bottom surface portion D is made flush, while in a shoe 50 shown in FIGS. 17 and 18, bottom surface portion C is formed such that it is recessed or grooved with respect to bottom surface portions B and D. Main portion 20 which is usually formed of a material having a certain degree of resilience is flexible at the side end surface portions of the groove of bottom surface portion C positioned at the boundary between bottom surface portions B and D by thus forming bottom surface portion C in a grooved manner. Thus, when the portion corresponding to bottom surface portion C lands on the ground after the landing of bottom surface portion D, the side end surface portion of the groove of bottom surface portion C bend, so that the impact may be absorbed and the foot may be advantageously readily supinated.

Both side ends of flat bottom surface portion D are recessed as if spooned out. Thus, the weight of bottom surface portion D of main portion 20 may be reduced, and as a result the vertical line passing through the center of gravity of the entire shoe sole including main portion 20 and toe portion 10 may be readily placed in bottom surface portion B. Therefore, one can stand in a natural and stable manner in shoes including the shoe soles according to the embodiment almost without using the sural muscles by bottom surface portion B.

Figure 27A:
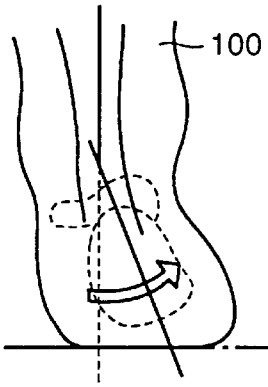
FIG. 27A PRIOR ART
FIGS. 27A, 27B and 27C are views for use in illustration of the pronation and supination of the back part of a foot.
Figure 27B:
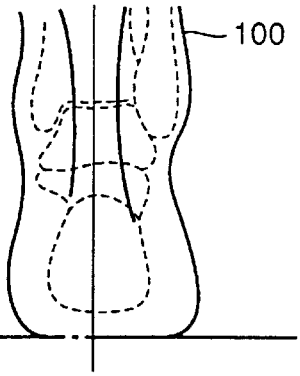
FIG. 27B PRIOR ART
Figure 27C:
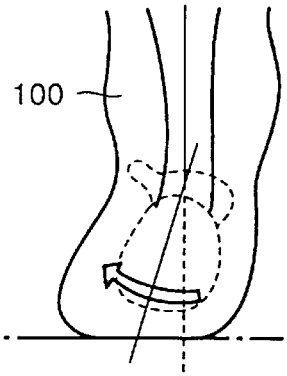
FIG. 27C PRIOR ART
Figure 28A:
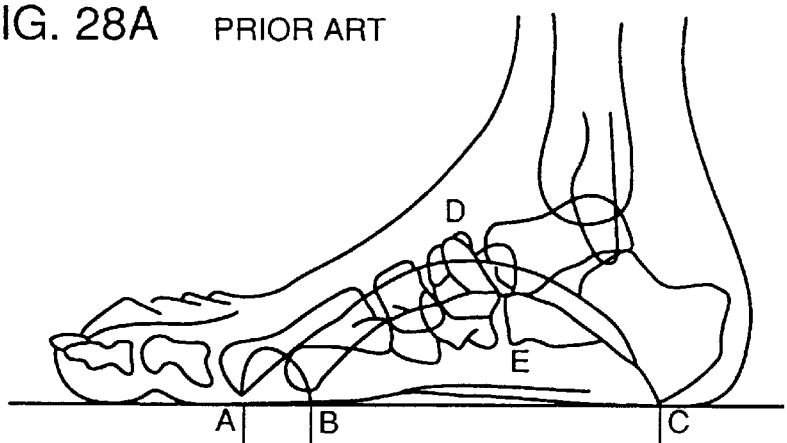
FIG. 28A PRIOR ART
FIGS. 28A and 28B are views for use in illustration of the arch structure of a foot.
Figure 28B:
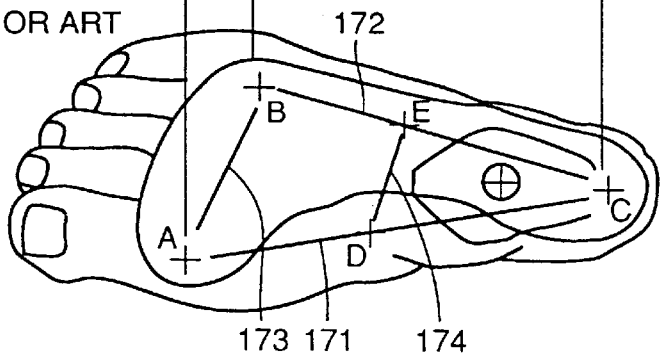
FIG. 28B PRIOR ART
Figure 29:
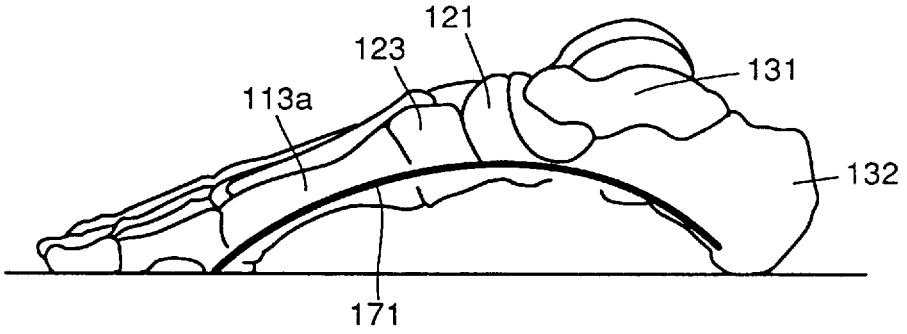
FIG. 29 PRIOR ART
FIG. 29 is a view for use in illustration of a medial longitudinal arch of a foot.
Figure 30:
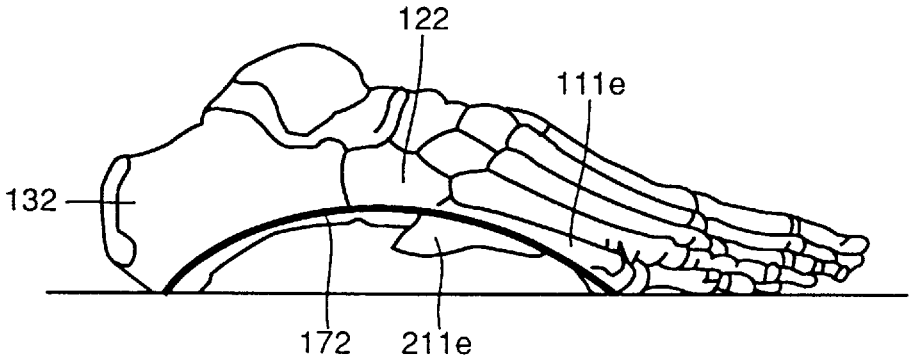
FIG. 30 PRIOR ART
FIG. 30 is a view for use in illustration of a lateral longitudinal arch of a foot.

Furthermore, both side ends of bottom surface portion D are recessed as if spooned out. In other words, both side edges of bottom surface portion D are chamfered. Thus, if a side edge portion of bottom surface portion D first touches the ground in the phase of the landing of the heel during jogging, the inner surface of the spooned out recess of bottom surface portion D touches the ground. As a result, a more medial side of bottom surface portion D can touch the ground than the case in which the outermost edge portion of bottom surface portion D touches the ground if bottom D does not have such a recess. Therefore, the pronation or supination of the back part portion of a foot as shown in FIG. 27, which is often observed in the case in which the outermost edge portion of portion D first touches the ground, may be effectively restricted.

In the shoe soles shown in FIGS. 15 to 18, as opposed to the shoe sole shown in FIG. 2, the boundary between bottom surface portions C and B winds rather than a straight line. More specifically, the boundary between bottom surface portion C and bottom surface portion B at the medial side portion is virtually in parallel to the boundary between bottom surface portion C and D, while the boundary between bottom surface portion C and B on the lateral side portion is inclined at a prescribed angle relative to the boundary between bottom surface portions C and D. In such a structure, the boundary between bottom surface portions C and B is shifted closer to bottom surface portion C as compared to the case shown in FIG. 2. Thus, after a foot supinates by bottom surface portion C, the movement may be more quickly shifted to pronation by bottom surface portion B, which prevents supination by bottom surface portion C from being excessively large. Thus, more smooth "Aori movement" is achieved.

Although the present invention has been described and illustrated in detail, it is clearly understood that the same is by way of illustration and example only and is not to be taken by way of limitation, the spirit and scope of the present invention being limited only by the terms of the appended claims. For example, the shoe sole according to the embodiment may equally effectively applied to the sole of a sandal.

What is claimed is:

1. A shoe sole, comprising:

a toe portion having a first upper surface for supporting toes in a forepart of a foot, and a first bottom surface portion in contact with a plane of walking said toe portion being made of a flexible material; and a main portion extending continuously from said toe portion said main portion including:

a second upper surface for supporting the metatarsal bones of said forepart, a middle part and a back part of said foot;

a second bottom surface portion flexibly connected to and substantially coplanar with said first bottom surface portion, a third bottom surface portion extending continuously from said second bottom surface portion at a first predetermined inclination angle and including a medial side and a lateral side said medial side having a greater thickness than said lateral side and a fourth bottom surface portion extending continuously from said third bottom surface portion at a second predetermined inclination angle.

2. The shoe sole as recited in claim 1, wherein:

said main portion is formed from a material having a predetermined hardness sufficient for supporting a body weight of a wearer; and said toe portion is formed from a material having a hardness less than said predetermined hardness.

3. The shoe sole as recited in claim 1, wherein said third bottom surface portion defines a first width on the medial side of the foot and a second width on the lateral side of the foot, said first width being smaller than said second width.

4. The shoe sole as recited in claim 1, wherein said third bottom surface portion is recessed relative recessed relative to said second and fourth bottom surface portions.

5. The shoe sole as recited in claim 1, wherein said fourth bottom surface portion includes a recess on both a medial side end and a lateral side end thereof.

6. The shoe sole as recited in claim 1, wherein a first vertical line through a center of gravity of said shoe passes through said second bottom surface portion.

7. The shoe sole as recited in claim 1, wherein said third bottom portion is shorter in length than said fourth bottom portion.

8. The shoe sole as recited in claim 1 wherein said second upper surface extends from said first upper surface at a third predetermined inclination angle.

9. A sandal comprising:

a sole including:

a toe portion having a first upper surface for supporting toes in a forepart of a foot, and a first bottom surface portion in contact with a plane of walking; and a main portion extending continuously from said toe portion, said main portion including:

a second upper surface for supporting the metatarsal bones of said forepart, a middle part and a back part of said foot;

a second bottom surface portion flexibly connected in a flexible manner to and substantially coplanar with said first bottom surface portion, a third bottom surface portion extending continuously from said second bottom surface portion at a first predetermined inclination angle and including a medial side and a lateral side, said medial side having a greater thickness than said lateral side; and a fourth bottom surface portion extending continuously from said third bottom surface portion at a second predetermined inclination angle.

* * * * *